US007753021B2

(12) United States Patent
Arnold et al.

(10) Patent No.: US 7,753,021 B2
(45) Date of Patent: Jul. 13, 2010

(54) VEHICLES INCLUDING FRAME DEFINING SPARK PLUG ACCESS APERTURE AND METHODS

(75) Inventors: David W. Arnold, Glendale, CA (US); Philip Tsiaras, Hanover, NH (US)

(73) Assignee: Honda Motor Company, Ltd., Tokyo (JP)

( * ) Notice: Subject to any disclaimer, the term of this patent is extended or adjusted under 35 U.S.C. 154(b) by 119 days.

(21) Appl. No.: 12/178,941

(22) Filed: Jul. 24, 2008

(65) Prior Publication Data

US 2010/0018488 A1 Jan. 28, 2010

(51) Int. Cl.
*H01T 13/00* (2006.01)
*H01T 13/02* (2006.01)

(52) U.S. Cl. ..... 123/169 PH; 123/169 PA

(58) Field of Classification Search ..... 123/169 PH, 123/169 R, 169 CB, 169 PA; 313/118; 248/230.01
See application file for complete search history.

(56) References Cited

U.S. PATENT DOCUMENTS 1,353,959 A * 9/1920 Holst ..... 123/146.5 B
3,683,873 A * 8/1972 Tarter ..... 123/41.82 R
3,935,852 A * 2/1976 Donovan et al. ..... 123/647
3,961,611 A * 6/1976 Frankle et al. ..... 123/551
4,534,322 A * 8/1985 Matsuda et al. ..... 123/54.4
4,546,843 A * 10/1985 Koinuma et al. ..... 180/229
4,964,319 A * 10/1990 Chang ..... 81/58.3
5,044,646 A * 9/1991 Iiga et al. ..... 180/219
5,070,824 A * 12/1991 Morishita ..... 123/41.82 R
5,568,783 A 10/1996 Ditchfield
6,508,216 B2 * 1/2003 Holmes et al. ..... 123/169 PA
6,655,334 B2 * 12/2003 Inagaki et al. ..... 123/169 PA
6,880,540 B2 * 4/2005 Fuma et al. ..... 123/634
6,886,514 B2 * 5/2005 Matsuda ..... 123/169 PA
2004/0168654 A1 9/2004 Radtke

* cited by examiner

*Primary Examiner*—Mahmoud Gimie
(74) *Attorney, Agent, or Firm*—Ulmer & Berne LLP

(57) ABSTRACT

A vehicle, such as a motorcycle, includes an engine and a frame. The engine includes a cylinder housing and a spark plug. The cylinder housing defines a spark plug aperture. The spark plug is received within the spark plug aperture. The frame supports the engine and comprises a frame member. The frame member is adjacent to the cylinder housing and defines an access aperture. The access aperture is substantially aligned with the spark plug aperture. The access aperture is configured to facilitate installation and removal of the spark plug with respect to the spark plug aperture. Methods of installing and replacing a spark plug are also provided.

25 Claims, 2 Drawing Sheets

VEHICLES INCLUDING FRAME DEFINING SPARK PLUG ACCESS APERTURE AND METHODS

TECHNICAL FIELD

A vehicle includes a frame which defines an access aperture for facilitating access to an engine's spark plug. Methods are also provided for installing and replacing a spark plug.

BACKGROUND

Many conventional vehicles, such as certain motorcycles, include an engine which is positioned upon the vehicle to attain optimal performance and styling of the vehicle, and when possible, to additionally facilitate accessibility for servicing of the engine's components.

SUMMARY

In accordance with one embodiment, a vehicle comprises an engine and a frame. The engine comprises a cylinder housing and a spark plug. The cylinder housing defines a spark plug aperture. The spark plug is received within the spark plug aperture. The frame supports the engine and comprises a frame member. The frame member is adjacent to the cylinder housing and defines an access aperture. The access aperture is substantially aligned with the spark plug aperture. The access aperture is configured to facilitate installation and removal of the spark plug with respect to the spark plug aperture.

In accordance with another embodiment, a motorcycle comprises an engine and a frame. The engine comprises a valve cover and a spark plug. The valve cover defines a spark plug aperture. The spark plug is threadably received within the spark plug aperture. The frame comprises an engine carriage. The engine carriage supports the engine. The engine carriage comprises a forward member. The forward member is adjacent to the valve covet and defines a substantially round access aperture. The access aperture extends through the forward member and is substantially aligned with the spark plug aperture. The access aperture is configured to facilitate installation and removal of the spark plug with respect to the spark plug aperture by facilitating passage of the spark plug at least partially through the access aperture.

In accordance with yet another embodiment, a method is provided of installing a spark plug into a spark plug aperture in a cylinder housing of an engine of a vehicle. The method comprises inserting an end of a socket wrench into an access aperture provided in a frame of the vehicle, wherein the access aperture is substantially aligned with the spark plug aperture. The end of the socket wrench is engaged with the spark plug. The end of the socket wrench is rotated such that the spark plug is threaded into engagement with the cylinder housing. The end of the socket wrench is removed from the access aperture.

In accordance with still another embodiment, a method is provided of replacing a first spark plug with a second spark plug. The method comprises inserting an end of a socket wrench into an access aperture provided in a frame of a vehicle. The end of the socket wrench is engaged with a first spark plug, wherein the first spark plug is threadably received within a spark plug aperture in a cylinder housing of an engine of the vehicle, and wherein the spark plug aperture is substantially aligned with the access aperture. The end of the socket wrench is rotated such that the first spark plug is threaded from engagement with the cylinder housing. The end of the socket wrench is removed from the access aperture. The first spark plug is withdrawn from the cylinder housing. The end of the socket wrench is inserted into the access aperture. The end of the socket wrench is engaged with the second spark plug. The end of the socket wrench is rotated such that the second spark plug is threaded into engagement with the cylinder housing. The end of the socket wrench is removed from the access aperture.

BRIEF DESCRIPTION OF THE DRAWINGS

It is believed that certain embodiments will be better understood from the following description taken in conjunction with the accompanying drawings in which.

DETAILED DESCRIPTION

Figure 1:
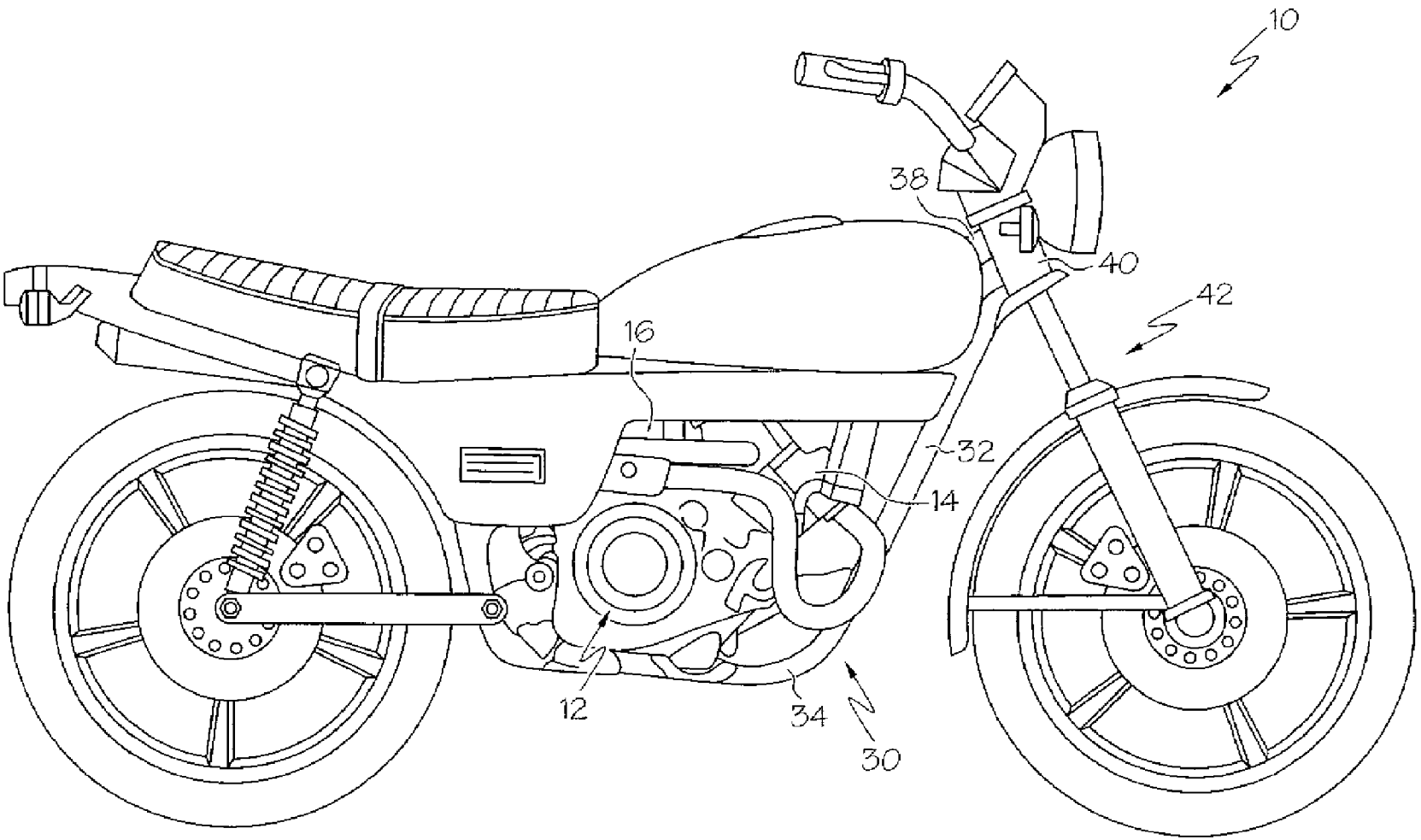
FIG. 1 is a side elevational view of a motorcycle in accordance with one embodiment.

Embodiments are hereinafter described in detail in connection with the views and examples of FIGS. 1-2, wherein like numbers indicate the same or corresponding elements throughout the views. A vehicle in accordance with one embodiment includes an engine and a frame. For example, FIG. 1 depicts a motorcycle 10 having an engine 12 and a frame 30. While the engine 12 is shown to comprise a V-twin engine, meaning that the engine is a V-type engine having only two pistons, it will be appreciated that a vehicle in accordance with alternative embodiments can include other types of engines such as, for example, single cylinder engines, multi-cylinder non-V-type engines, or multi-cylinder V-type engines having more than two pistons. Such engines can be configured to consume any of a variety of fuels including, for example, gasoline, diesel fuel, ethanol, kerosene, jet fuel, alcohol, natural gas, propane, and hydrogen.

Referring more particularly to FIG. 1, the engine 12 is shown to comprise a forward cylinder housing 14 and a rearward cylinder housing 16 which are arranged in a V-shape and which are configured to support respective pistons of the engine 12 which are also arranged in a V-shape. Each of the cylinder housings 14, 16 can comprise a respective valve cover (e.g., forward valve cover 18) which is attached to the remainder of the respective cylinder housing (e.g., with bolts). Each of the valve covers (e.g., forward valve cover 18) can define a respective spark plug aperture (e.g., 20 in FIG. 2) which is configured for receiving a spark plug (e.g., 50 in FIG. 2). In one embodiment, a spark plug aperture (e.g., 20) can comprise a threaded aperture for threadably receiving a spark plug (e.g., 50). It will be appreciated, however, that one or more spark plug apertures might be defined by a valve cover, by another portion of a cylinder housing, and/or by another portion of the engine in any of a variety of other suitable locations and configurations.

As shown in FIG. 1, the frame 30 of the motorcycle 10 is shown to include a head tube 40, an upper member 38, and an engine carriage. The head tube 40 is shown to rotatably support a fork 42. The engine carriage is shown to depend from the upper member 38 and to comprise a forward member 32 and a lower member 34. The upper member 38 is shown to extend at a downward incline from the head tube 40 toward a rearward end of the frame 30. The forward member 32 is shown to extend generally vertically and downwardly from the upper member 38. The lower member 34 is shown to extend generally horizontally and rearwardly from the forward member 32 to a rearward end of the upper member 38. The engine 12 can be attached (e.g., with bolts) to the upper member 38, the forward member 32, and/or the lower member 34 which, together, can support the engine 12 with respect to the remainder of the motorcycle 10. It will be appreciated that an engine can be partially or entirely supported by one or more frame members of a vehicle in any of a variety of other suitable configurations.

Figure 2:
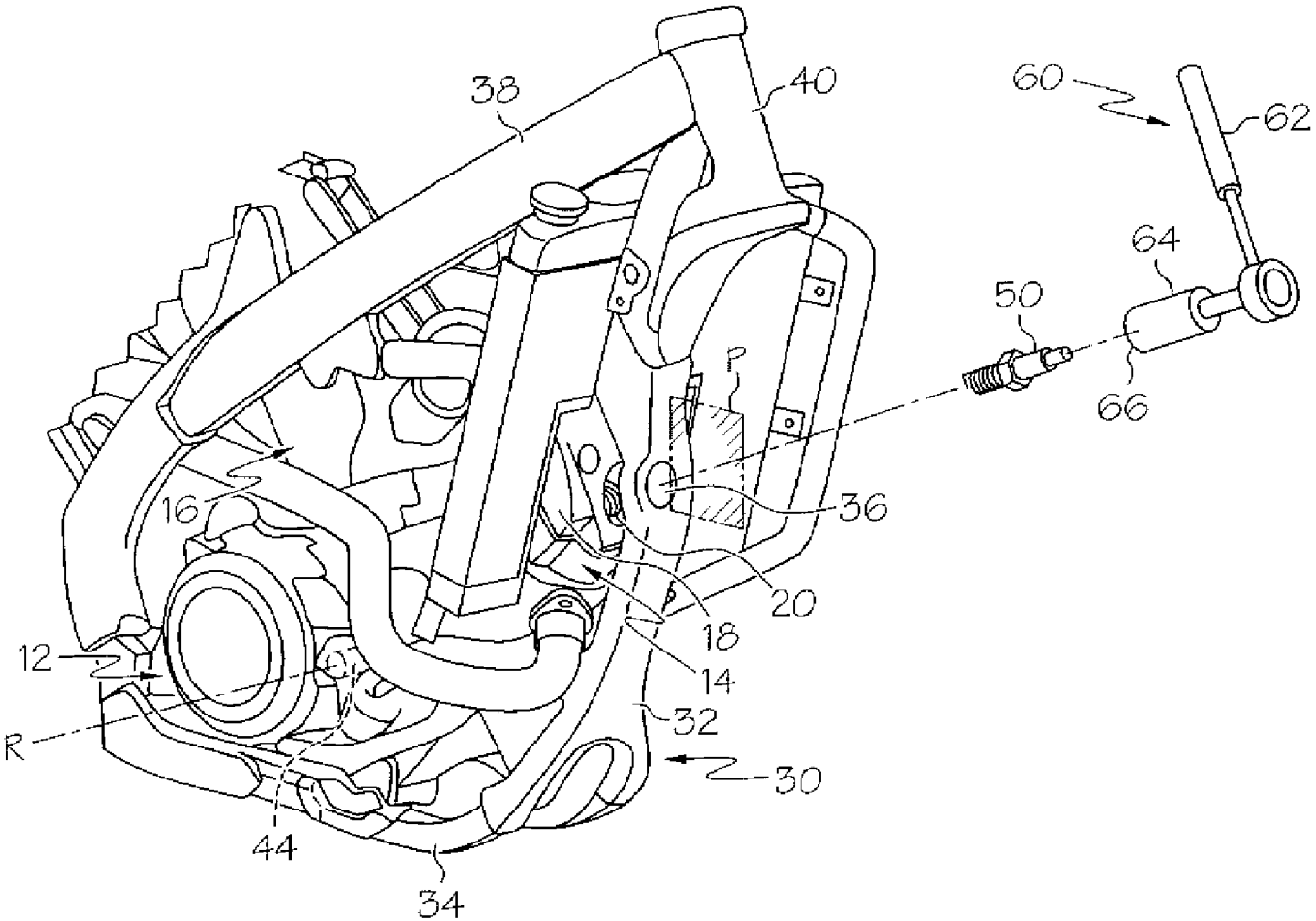
FIG. 2 is a front perspective view depicting a wrench in association with certain components of the motorcycle of FIG. 1, wherein the spark plug is shown as being removed for clarity of illustration.

In the embodiment of FIGS. 1-2, it can be seen that the engine 12 is attached to the frame 30 such that the forward member 32 is adjacent to the forward valve cover 18 of the forward cylinder housing 14 of the engine 12. FIG. 2 depicts the frame 30 as including a single forward member 32 which is centrally located with respect to the engine 12 and the motorcycle 10 (as opposed to two or more spaced forward members disposed upon opposite sides of an engine as is typical of certain conventional motorcycles). When a forward member (e.g., 32) is centrally located as shown in FIG. 2, the forward member 32 might be sufficiently closely disposed to the spark plug aperture 20 defined by the forward valve cover 18 such that it might not be possible to insert the spark plug 50 and/or an end of a socket wrench into the gap between the forward member 32 and the forward valve cover 18 for installing or removing the spark plug 50 with respect to the spark plug aperture 20. Accordingly, the forward member 32 is shown to define an access aperture 36.

The access aperture 36 can be defined by the forward member 32 to facilitate quick and easy access to the spark plug 50 and the spark plug aperture 20, and without necessitating removal of the engine 12 and/or portions of the frame 30. While the access aperture 36 can facilitate access to the spark plug 50 and/or the spark plug aperture 20 in this manner, it will be appreciated that the access aperture 36 might not provide access to the entire forward cylinder housing 14. In particular, portions of the forward member 32 which are adjacent to the access aperture 36 can substantially prevent access to certain portions of the cylinder housing 14, and more particularly to certain portions of the forward valve cover 18, which are adjacent to the spark plug aperture 20.

While the access aperture 36 is shown to be substantially round and to extend through the forward member 32, it will be appreciated that an access aperture can alternatively be provided in any of a variety of other configurations. It will also be appreciated that an access aperture for providing access to a spark plug can be provided through a member or portion of a vehicle's frame other than a forward member, and can provide access to a spark plug aperture and/or a spark plug of a cylinder housing other than a forward cylinder housing of an engine. In one embodiment, an access aperture can be formed in a frame member during a process of molding or stamping the frame member. In another embodiment, an access aperture can be formed in a frame member by drilling, punching, or machining a frame member which has previously been cast or stamped.

The access aperture 36 is shown to be substantially aligned with the spark plug aperture 20 defined by the forward valve cover 18. In this configuration, it will be appreciated that the access aperture 36 can facilitate easy installation and removal of the spark plug 50 with respect to the spark plug aperture 20 (e.g., without necessitating removal of the engine 12 or the forward member 32) by facilitating passage of the spark plug 50 at least partially through the access aperture 36. The access aperture 36 can also facilitate access by an end (e.g., 66 in FIG. 2) of a socket wrench (e.g., 60 in FIG. 2) to the spark plug aperture 20 and/or the spark plug 50 for tightening or loosening of the spark plug 50 with respect to the spark plug aperture 20.

While the access aperture 36 is shown in FIG. 2 to be adequately sized to facilitate passage of an end of a socket wrench and a spark plug, it will be appreciated that, in one alternative embodiment, the access aperture might be sufficiently large to facilitate passage of an end of the socket wrench, but not the spark plug. In such circumstance, the end of the socket wrench might access the spark plug through the access aperture, but the spark plug might be insertable and removable through a gap located between the forward valve cover and the forward member of the frame. In another embodiment, the access aperture might be adequately sized to facilitate passage of the spark plug, but not an end of a socket wrench. In such circumstance, the spark plug might be insertable and removable through the access aperture, but the end of the socket wrench might be insertable into a gap located between the forward valve cover and the forward member of the frame.

Once the spark plug 50 is threaded into the spark plug aperture 20, such as through use of the socket wrench 60, a spark plug cable (not shown) can be attached to the spark plug 50 for conducting electrical power to the spark plug 50 during normal use of the motorcycle 10. In one embodiment, the spark plug cable can be routed to the spark plug 50 by passing the spark plug cable into a gap located between the forward valve cover 18 and the forward member 32 of the frame 30. In another embodiment, the spark plug cable can be routed to the spark plug 50 by passing the spark plug cable through the access aperture 36. It will be appreciated, however, that a spark plug cable or any other vehicle ignition component(s) (e.g., an ignition coil) can be routed to a spark plug in any of a variety of other suitable configurations.

The access aperture 36 can be defined by the forward member 32 in any of a variety of suitable locations and arrangements. For example, in one embodiment, as shown in FIG. 2, the engine 12 can comprise a crankshaft 44 having a rotational axis R. An imaginary plane (e.g., a portion of which is depicted as "P" in FIG. 2) can centrally bisect the motorcycle 10 perpendicular to the rotational axis R of the crankshaft 44. It will be appreciated that such an imaginary plane can include the steering axis of the motorcycle 10 (e.g., defined by the head tube 40) and can be perpendicular to a rotational axis of the rear wheel of the motorcycle 10. This imaginary plane can also centrally bisect the forward member 32 of the engine carriage as well as other components of the motorcycle 10, and can intersect the access aperture 36, the spark plug aperture 20, and other components of the motorcycle 10. In other embodiments, an imaginary plane can centrally bisect an access aperture and/or a spark plug aperture.

It will be appreciated that provision of the access aperture 36 in the forward member 32 of the frame 30 can facilitate efficient methods of installing and removing the spark plug 50 with respect to the spark plug aperture 20 defined by the forward valve cover 18 of the engine 12. Were it not for the presence of the access aperture 36, it will be appreciated that removal and installation of the spark plug 50 with respect to the spark plug aperture 20 might require removal of the engine 12 and/or a portion of the frame (e.g., the forward member 32) from the motorcycle 10 which, from a practical perspective, would be so difficult as to potentially render the engine/frame configuration of FIGS. 1-2 as being impractical for implementation upon a production vehicle. However, by providing the access aperture 36 as shown, for example, in FIG. 2, the spark plug 50 can be easily removed or installed with respect to the spark plug aperture 20, thereby facilitating convenient servicing.

For example, in one embodiment, in order to remove the spark plug 50 from the spark plug aperture 20, an operator can insert the end 66 of the socket wrench 60 into the access aperture 36, and can engage the end 66 of the socket wrench 60 with the spark plug 50. In one embodiment, as shown in FIG. 2, the socket wrench 60 can comprise a ratchet having the end 66 provided by a socket portion 64. The socket portion 60 can include an interior aperture which is shaped to correspondingly contact exterior surfaces of the spark plug 50. Accordingly, once the socket portion 64 is engaged with the spark plug 50, by then rotating the socket portion 64 (generally counterclockwise, and such as through use of a handle 62 or a motorized tool), the spark plug 50 can be threaded from engagement with the spark plug aperture 20 defined by the forward valve cover 18. The end 66 of the socket wrench 60 can then be removed from the access aperture 36, and the spark plug 50 can be withdrawn from the spark plug aperture 20, such as by passing the spark plug 50 at least partially (i.e., partially or completely) through the access aperture 36.

In order to install the spark plug 50 into the spark plug aperture 20, an operator can insert the spark plug, 50 into the spark plug aperture 20, such as by passing the spark plug 50 at least partially (i.e., partially or completely) through the access aperture 36. The operator can also insert the end 66 of the socket wrench 60 into the access aperture 36, and can engage the end 66 of the socket wrench 60 with the spark plug 50. This engagement can occur before, during, or after the spark plug 50 is inserted into the spark plug aperture 20 and/or the access aperture 36. Once the socket portion 64 is engaged with the spark plug 50, by then rotating the socket portion 64 (generally clockwise, and such as through use of the handle 62 or a motorized tool), the spark plug 50 can be threaded into engagement with the spark plug aperture 20 defined by the forward valve cover 18. The end 66 of the socket wrench 60 can then be removed from the access aperture 36. Inspection of the spark plug 50 can be achieved by following the removal method described above, inspecting the spark plug 50, and then following the installation method described above. Replacement of the spark plug 50 can be achieved by following the removal method described above with respect to an original spark plug (e.g., often termed an "old" or "bad" spark plug), and then following the installation method described above with respect to a different spark plug (e.g., often termed a "new" or "good" spark plug).

While the foregoing makes reference to the motorcycle 10 of FIGS. 1-2, it will be appreciated that any of a variety of other vehicles might be provided with a frame having a spark plug access aperture. Such other vehicles might comprise, for example, an automobile, a truck, a van, a scooter, a recreational vehicle, a watercraft, an aircraft, agricultural equipment, construction equipment, a toy, an all terrain vehicle ("ATV"), a mower, or any of a variety of other vehicles.

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate certain principles and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A vehicle comprising:

an engine comprising a cylinder housing and a spark plug, the cylinder housing defining a spark plug aperture, the spark plug received within the spark plug aperture; and a frame supporting the engine and comprising a frame member, the frame member being adjacent to the cylinder housing and defining an access aperture, the access aperture being substantially aligned with the spark plug aperture, and the access aperture being configured to facilitate installation and removal of the spark plug with respect to the spark plug aperture.

2. The vehicle of claim 1 wherein the cylinder housing comprises a valve cover, the valve cover defines the spark plug aperture, the spark plug aperture comprises a threaded aperture, and the spark plug is threadably received within the threaded aperture.

3. The vehicle of claim 1 wherein portions of the frame member adjacent to the access aperture substantially prevent access to portions of the cylinder housing adjacent to the spark plug aperture.

4. The vehicle of claim 1 wherein the frame member comprises a forward member of an engine carriage.

5. The vehicle of claim 4 wherein the engine comprises a crankshaft having a rotational axis, an imaginary plane centrally bisects the vehicle perpendicular to the rotational axis of the crankshaft, and the imaginary plane bisects the forward member of the engine carriage.

6. The vehicle of claim 5 wherein the imaginary plane centrally bisects the forward member of the engine carriage.

7. The vehicle of claim 6 wherein the imaginary plane intersects the access aperture.

8. The vehicle of claim 4 wherein the cylinder housing comprises a forward cylinder housing of a V-twin engine.

9. The vehicle of claim 1 wherein the access aperture is substantially round and extends through the frame member.

10. The vehicle of claim 1 wherein the access aperture is configured to facilitate passage of the spark plug at least partially through the access aperture and into the spark plug aperture.

11. The vehicle of claim 1 comprising a motorcycle.

12. The vehicle of claim 1, wherein:

the access aperture extends through the frame member.

13. The vehicle of claim 1, wherein:

the frame member comprises a forward member of an engine carriage;

the frame further comprises a head tube and an upper member; and the upper member extends at a downward incline from the head tube toward a rearward end of the frame.

14. A motorcycle comprising:

an engine comprising a valve cover and a spark plug, the valve cover defining a spark plug aperture, the spark plug threadably received within the spark plug aperture; and a frame comprising an engine carriage, the engine carriage supporting the engine, the engine carriage comprising a forward member, the forward member being adjacent to the valve cover and defining a substantially round access aperture, the access aperture extending through the forward member and being substantially aligned with the spark plug aperture, and the access aperture being configured to facilitate installation and removal of the spark plug with respect to the spark plug aperture by facilitating passage of the spark plug at least partially through the access aperture.

15. The motorcycle of claim 14 wherein portions of the forward member adjacent to the access aperture substantially prevent access to portions of the cylinder housing adjacent to the spark plug aperture.

16. The motorcycle of claim 14 wherein the engine comprises a crankshaft having a rotational axis, an imaginary plane centrally bisects the motorcycle perpendicular to the rotational axis of the crankshaft, and the imaginary plane bisects the forward member of the engine carriage.

17. The motorcycle of claim 16 wherein the imaginary plane centrally bisects the forward member of the engine carriage.

18. The motorcycle of claim 17 wherein the imaginary plane intersects the access aperture.

19. The motorcycle of claim 15 wherein the valve cover comprises a forward valve cover of a V-twin engine.

20. A method of installing a spark plug into a spark plug aperture in a cylinder housing of an engine of a vehicle, the method comprising:

inserting an end of a socket wrench into an access aperture provided in a frame of the vehicle, wherein the frame supports the engine and the access aperture is substantially aligned with the spark plug aperture;

engaging the end of the socket wrench with the spark plug;

rotating the end of the socket wrench such that the spark plug is threaded into engagement with the cylinder housing; and removing the end of the socket wrench from the access aperture.

21. The method of claim 20 further comprising inserting the spark plug at least partially through the access aperture and into the spark plug aperture.

22. The method of claim 20, wherein:

the frame includes a frame member; and the access aperture extends through the frame member.

23. A method of replacing a first spark plug with a second spark plug, the method comprising:

inserting an end of a socket wrench into an access aperture provided in a frame of a vehicle, wherein the frame supports an engine of the vehicle;

engaging the end of the socket wrench with a first spark plug, wherein the first spark plug is threadably received within a spark plug aperture in a cylinder housing of the engine of the vehicle, and wherein the spark plug aperture is substantially aligned with the access aperture;

rotating the end of the socket wrench such that the first spark plug is threaded from engagement with the cylinder housing;

removing the end of the socket wrench from the access aperture;

withdrawing the first spark plug from the cylinder housing;

inserting the end of the socket wrench into the access aperture;

engaging the end of the socket wrench with the second spark plug;

rotating the end of the socket wrench such that the second spark plug is threaded into engagement with the cylinder housing; and removing the end of the socket wrench from the access aperture.

24. The method of claim 23 further comprising withdrawing the first spark plug from the cylinder housing by passing the first spark plug at least partially through the access aperture, and further comprising inserting the second spark plug at least partially through the access aperture and into the spark plug aperture.

25. The method of claim 23, wherein:

the frame includes a frame member; and the access aperture extends through the frame member.

* * * * *